US008305289B2

(12) United States Patent
Lo

(10) Patent No.: US 8,305,289 B2
(45) Date of Patent: Nov. 6, 2012

(54) ANTENNA DEVICE WHOSE VERTICAL AND HORIZONTAL POSITIONS CAN BE ADJUSTED

(75) Inventor: Shan-Gow Lo, Tainan (TW)

(73) Assignee: Jebsee Electronics Co., Ltd., Tainan (TW)

( * ) Notice: Subject to any disclaimer, the term of this patent is extended or adjusted under 35 U.S.C. 154(b) by 350 days.

(21) Appl. No.: 12/846,885

(22) Filed: Jul. 30, 2010

(65) Prior Publication Data

US 2012/0026065 A1 Feb. 2, 2012

(51) Int. Cl.
*H01Q 1/10* (2006.01)

(52) U.S. Cl. ..... 343/890; 343/892

(58) Field of Classification Search ..... 343/890–892
See application file for complete search history.

(56) References Cited

U.S. PATENT DOCUMENTS

| | | | | |
|---|---|---|---|---|
| 6,037,913 | A * | 3/2000 | Johnson | 343/882 |
| 6,195,066 | B1 * | 2/2001 | Pegues et al. | 343/883 |
| 6,262,691 | B1 * | 7/2001 | Austin et al. | 343/890 |
| 6,407,713 | B1 * | 6/2002 | Mallenius | 343/765 |

* cited by examiner

*Primary Examiner* — James H Cho
(74) *Attorney, Agent, or Firm* — Alan Kamrath; Kamrath IP Lawfirm, PA

(57) ABSTRACT

An antenna device includes a support pole, a fixing seat mounted on the support pole, at least one clamping member mounted on the support pole and combined with the fixing seat by at least one locking bolt, and an antenna box mounted on the fixing seat. The fixing seat is provided with a square mounting sleeve which has a mounting chamber and two opposite fixing holes. The antenna box has a square insertion block inserted into the mounting chamber. The insertion block has a plurality of adjusting holes. Thus, the orientation of the antenna box is adjustable so that the antenna box can be disposed at a horizontal position or a vertical position so as to receive a wireless signal exactly and clearly.

2 Claims, 5 Drawing Sheets

ANTENNA DEVICE WHOSE VERTICAL AND HORIZONTAL POSITIONS CAN BE ADJUSTED

BACKGROUND OF THE INVENTION

1. Field of the Invention

The present invention relates to an antenna device and, more particularly, to an antenna device for receiving television signals.

2. Description of the Related Art

An antenna device is mounted outdoors for receiving television signals. A conventional antenna device comprises a skeleton having a fishbone, a plurality of aluminum tubes mounted on and parallel with the skeleton, an antenna box mounted on the bottom of the skeleton and connected with an antenna, and a cable connected between the antenna box and an indoor television. The conventional antenna device is mounted on an object, such as a pole and the like, which is located at higher location so as to receive the television signals clearly. However, the receiving angles of the conventional antenna device cannot be adjusted easily and quickly so that the antenna cannot receive the television signals exactly and clearly.

BRIEF SUMMARY OF THE INVENTION

In accordance with the present invention, there is provided an antenna device, comprising a support pole, a fixing seat having a first end mounted on the support pole, at least one clamping member mounted on the support pole and combined with the first end of the fixing seat by at least one U-shaped locking bolt, and an antenna box mounted on a second end of the fixing seat.

The second end of the fixing seat is provided with a square hollow mounting sleeve. The mounting sleeve of the fixing seat has an inner portion formed with a mounting chamber and has a peripheral wall formed with two opposite fixing holes each connected to the mounting chamber. The antenna box has an inner portion containing an antenna unit therein. The antenna box has a side provided with a square insertion block inserted into the mounting chamber of the mounting sleeve of the fixing seat. The insertion block of the antenna box has a size smaller than that of the mounting chamber of the mounting sleeve of the fixing seat. The insertion block of the antenna box has a peripheral wall formed with a plurality of adjusting holes that can be aligned with the fixing holes of the mounting sleeve of the fixing seat.

The first end of the fixing seat has an end face provided with a first arc-shaped portion mounted on the support pole. The first arc-shaped portion of the fixing seat is provided with a serrated face engaging the support pole. The first end of the fixing seat has a peripheral wall formed with a plurality of through holes to allow passage of the locking bolt. The clamping member has a face provided with a second arc-shaped portion mounted on the support pole and combined with the first arc-shaped portion of the fixing seat. The clamping member has two opposite ends each formed with a through bore to allow passage of the locking bolt.

The primary objective of the present invention is to provide an antenna device whose vertical and horizontal positions can be adjusted.

According to the primary advantage of the present invention, the orientation of the antenna box is adjustable so that the antenna box can be disposed at a horizontal position or a vertical position so as to receive a wireless signal exactly and clearly.

According to another advantage of the present invention, a user only needs to insert the insertion block of the antenna box into the mounting sleeve of the fixing seat to attach the antenna box to the fixing seat so that the position of the antenna box can be adjusted easily and quickly.

According to a further advantage of the present invention, the insertion block of the antenna box is fixed in the mounting sleeve of the fixing seat so that the antenna box is combined with the fixing seat solidly and stably to prevent the antenna box from being deflected freely.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
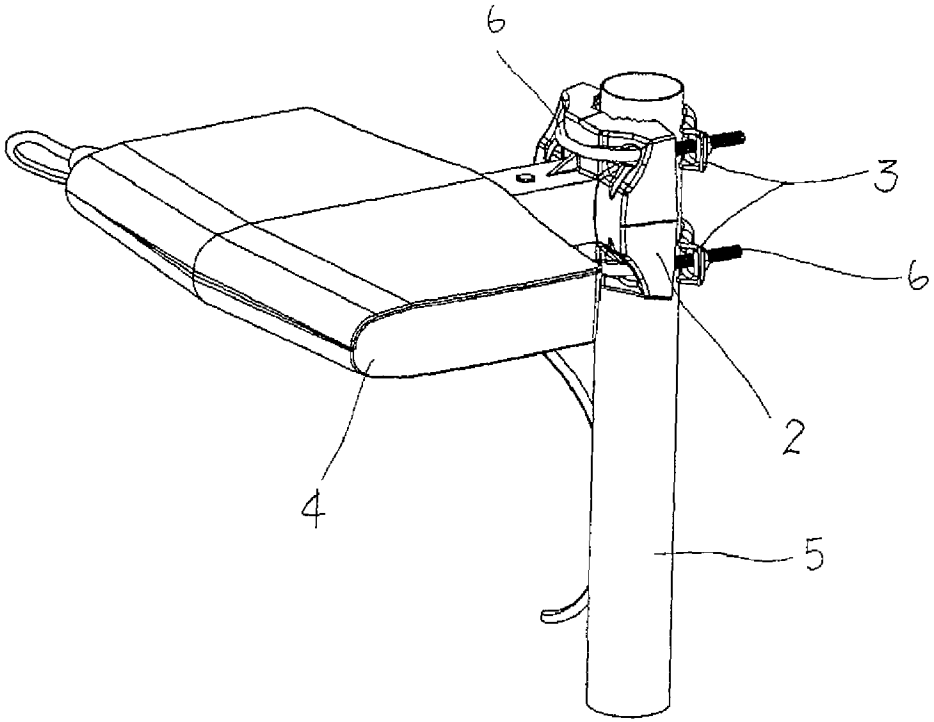
FIG. 1 is a perspective view of an antenna device in accordance with the preferred embodiment of the present invention.
Figure 3:
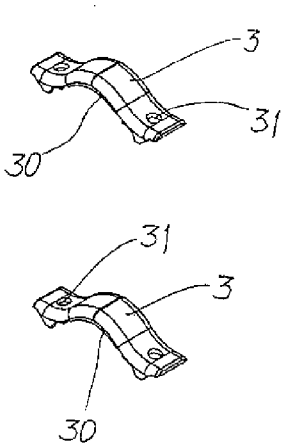
FIG. 3 is a perspective of at least one clamping member of the antenna device as shown in FIG. 1.
Figure 2:
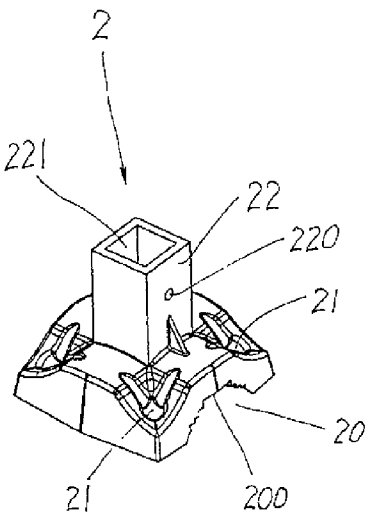
FIG. 2 is a perspective of a fixing seat of the antenna device as shown in FIG. 1.
Figure 4:
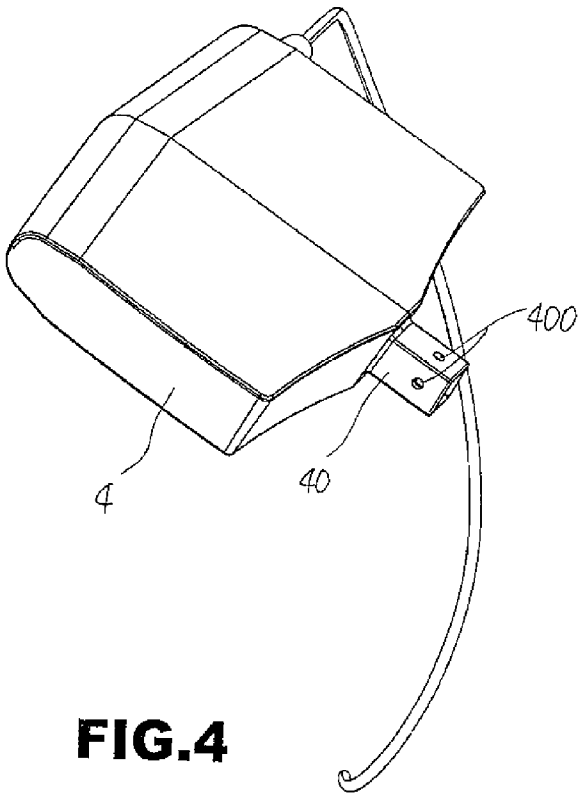
FIG. 4 is a perspective of an antenna box of the antenna device as shown in FIG. 1.

Referring to the drawings and initially to FIGS. 1-4, an antenna device in accordance with the preferred embodiment of the present invention comprises a support pole 5, a fixing seat 2 having a first end mounted on the support pole 5, at least one clamping member 3 mounted on the support pole 5 and combined with the first end of the fixing seat 2 by at least one U-shaped locking bolt 6, and an antenna box 4 mounted on a second end of the fixing seat 2.

The first end of the fixing seat 2 has an end face provided with a first arc-shaped portion 20 mounted on the support pole 5. The first arc-shaped portion 20 of the fixing seat 2 is provided with a serrated face 200 engaging the support pole 5 tightly and closely. The first end of the fixing seat 2 has a peripheral wall formed with a plurality of through holes 21 to allow passage of the locking bolt 6. The second end of the fixing seat 2 is provided with a square hollow mounting sleeve 22. The mounting sleeve 22 of the fixing seat 2 has an inner portion formed with a mounting chamber 221 and has a peripheral wall formed with two opposite fixing holes 220 each connected to the mounting chamber 221.

The antenna box 4 has an inner portion containing an antenna unit therein. The antenna box 4 has a side provided with a square insertion block 40 inserted into the mounting chamber 221 of the mounting sleeve 22 of the fixing seat 2. The insertion block 40 of the antenna box 4 has a size smaller than that of the mounting chamber 221 of the mounting sleeve 22 of the fixing seat 2. The insertion block 40 of the antenna box 4 has a peripheral wall formed with a plurality of adjusting holes 400 that can be aligned with the fixing holes 220 of the mounting sleeve 22 of the fixing seat 2. The insertion block 40 of the antenna box 4 is combined with the mounting sleeve 22 of the fixing seat 2 by a fastening screw 61 and a fastening nut 62.

The clamping member 3 is an elongate sheet plate and has a face provided with a second arc-shaped portion 30 mounted on the support pole 5 and combined with the first arc-shaped portion 20 of the fixing seat 2. The clamping member 3 has two opposite ends each formed with a through bore 31 to allow passage of the locking bolt 6.

Figure 5:
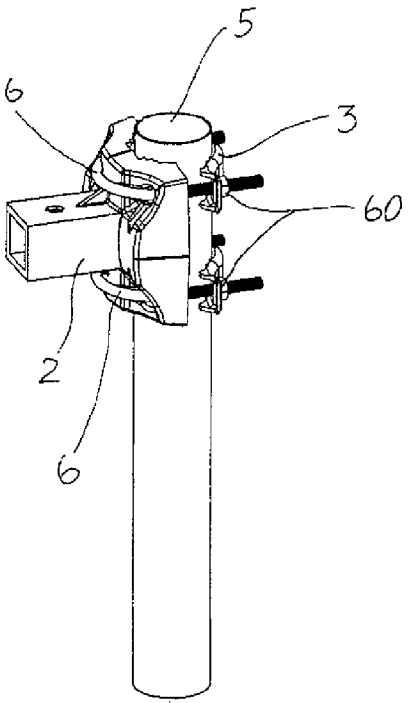
FIG. 5 is a partially perspective view of the antenna device as shown in FIG. 1.
Figure 6:
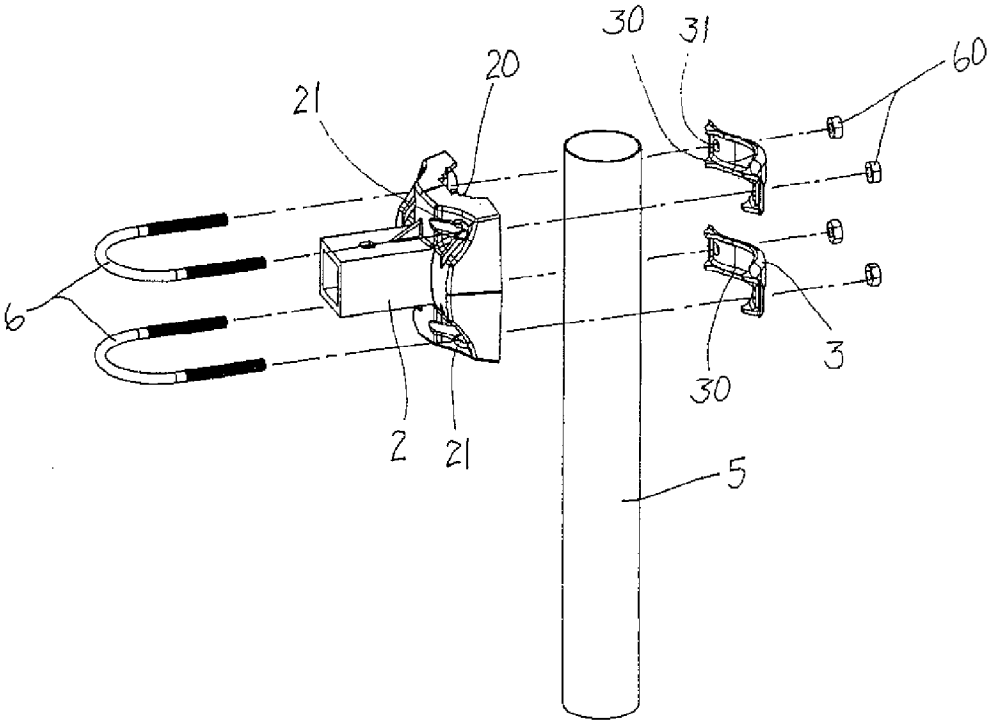
FIG. 6 is an exploded perspective view of the antenna device as shown in FIG. 5.
Figure 7:
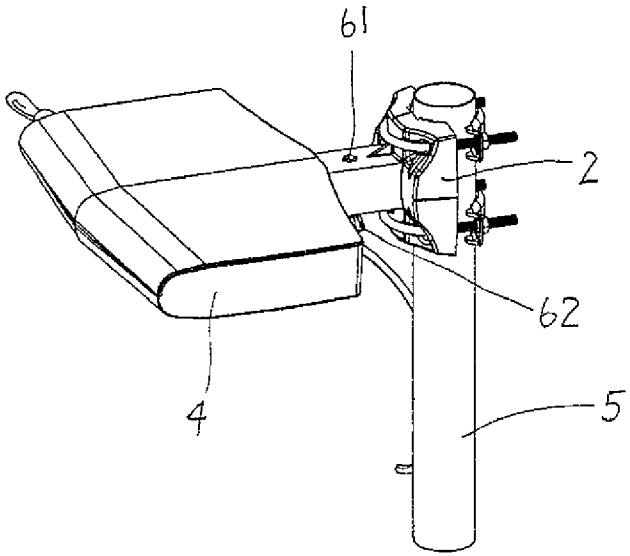
FIG. 7 is another perspective view of the antenna device as shown in FIG. 1.
Figure 8:
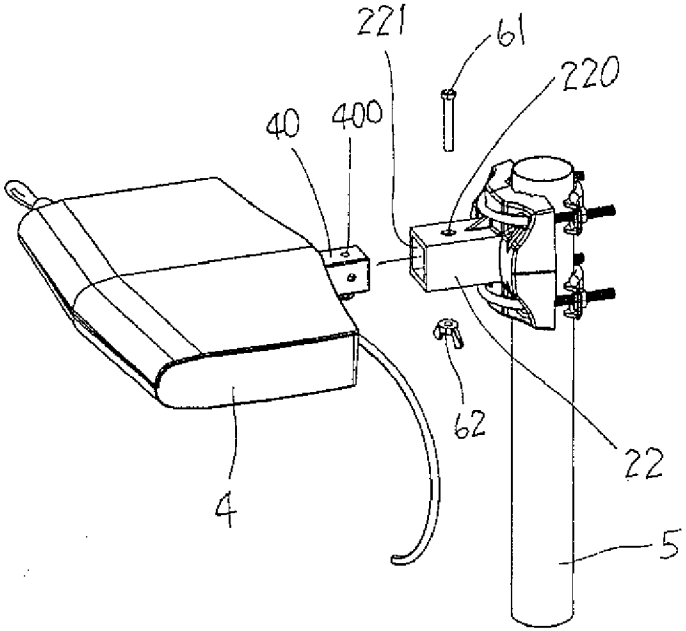
FIG. 8 is an exploded perspective view of the antenna device as shown in FIG. 7

In assembly, referring to FIGS. 5-8 with reference to FIGS. 1-4, the first arc-shaped portion 20 of the fixing seat 2 is mounted on the support pole 5. Then, the second arc-shaped portion 30 of the clamping member 3 is mounted on the support pole 5 and abuts the first arc-shaped portion 20 of the fixing seat 2. Then, the locking bolt 6 in turn extends through the through holes 21 of the fixing seat 2 and the through bores 31 of the clamping member 3 and is screwed with two locking nuts 60 so that the fixing seat 2 is combined with the clamping member 3 as shown in FIG. 5, and the support pole 5 is clamped between the fixing seat 2 and the clamping member 3. Then, the antenna box 4 is perpendicular to the support pole 5 as shown in FIG. 8. Then, the insertion block 40 of the antenna box 4 is inserted into the mounting chamber 221 of the mounting sleeve 22 of the fixing seat 2. Then, the fastening screw 61 in turn extends through the fixing holes 220 of the mounting sleeve 22 of the fixing seat 2 and the adjusting holes 400 of the insertion block 40 of the antenna box 4, and the fastening nut 62 is screwed onto the fastening screw 61 so that the antenna box 4 is combined with the fixing seat 2 as shown in FIG. 7. At this time, the antenna box 4 is perpendicular to the support pole 5, and the support pole 5 is perpendicular to the ground so that the antenna box 4 is parallel with the ground.

Figure 9:
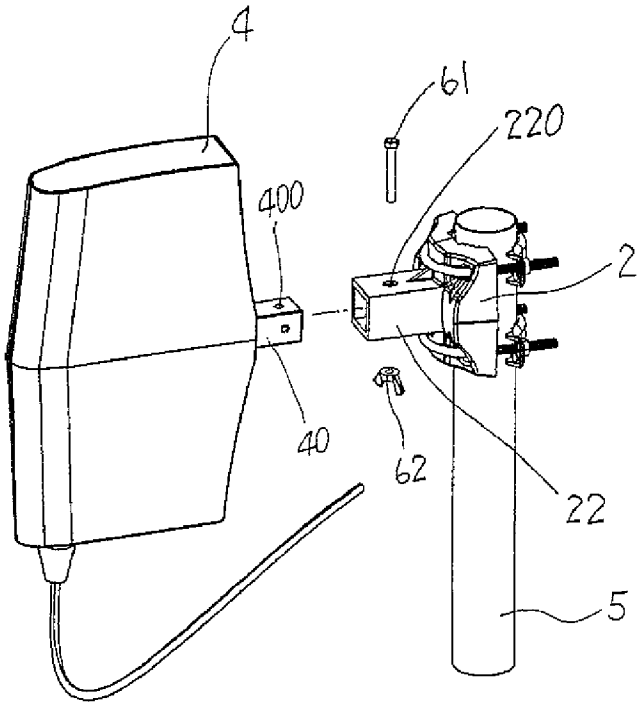
FIG. 9 is a partially exploded perspective view of the antenna device in accordance with the preferred embodiment of the present invention.

As shown in FIG. 9, the antenna box 4 is parallel with the support pole 5, and the support pole 5 is perpendicular to the ground so that the antenna box 4 is perpendicular to the ground.

Figure 10:
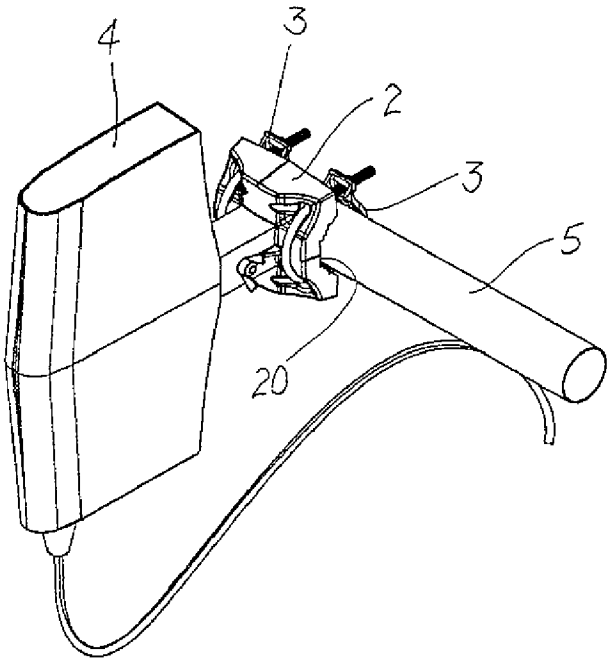
FIG. 10 is a perspective view of the antenna device in accordance with the preferred embodiment of the present invention.

As shown in FIG. 10, the antenna box 4 is perpendicular to the support pole 5, and the support pole 5 is parallel with the ground so that the antenna box 4 is perpendicular to the ground.

Accordingly, the orientation of the antenna box 4 is adjustable so that the antenna box 4 can be disposed at a horizontal position or a vertical position so as to receive a wireless signal exactly and clearly. In addition, a user only needs to insert the insertion block 40 of the antenna box 4 into the mounting sleeve 22 of the fixing seat 2 to attach the antenna box 4 to the fixing seat 2 so that the position of the antenna box 4 can be adjusted easily and quickly. Further, the insertion block 40 of the antenna box 4 is fixed in the mounting sleeve 22 of the fixing seat 2 so that the antenna box 4 is combined with the fixing seat 2 solidly and stably to prevent the antenna box 4 from being deflected freely.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An antenna device, comprising:

a support pole;

a fixing seat having a first end mounted on the support pole;

at least one clamping member mounted on the support pole and combined with the first end of the fixing seat by at least one U-shaped locking bolt; and an antenna box mounted on a second end of the fixing seat;

wherein the second end of the fixing seat is provided with a square hollow mounting sleeve;

the mounting sleeve of the fixing seat has an inner portion formed with a mounting chamber;

the mounting sleeve of the fixing seat has a peripheral wall formed with two opposite fixing holes each connected to the mounting chamber;

the antenna box has an inner portion containing an antenna unit therein;

the antenna box has a side provided with a square insertion block inserted into the mounting chamber of the mounting sleeve of the fixing seat;

the insertion block of the antenna box has a size smaller than that of the mounting chamber of the mounting sleeve of the fixing seat;

the insertion block of the antenna box has a peripheral wall formed with a plurality of adjusting holes that can be aligned with the fixing holes of the mounting sleeve of the fixing seat.

2. The antenna device of claim 1, wherein the first end of the fixing seat has an end face provided with a first arc-shaped portion mounted on the support pole;

the first arc-shaped portion of the fixing seat is provided with a serrated face engaging the support pole;

the first end of the fixing seat has a peripheral wall formed with a plurality of through holes to allow passage of the locking bolt;

the clamping member has a face provided with a second arc-shaped portion mounted on the support pole and combined with the first arc-shaped portion of the fixing seat;

the clamping member has two opposite ends each formed with a through bore to allow passage of the locking bolt.

* * * * *